United States Patent [19]

Glassel

[11] Patent Number: 4,861,190

[45] Date of Patent: Aug. 29, 1989

[54] RIDE-ON ROAD STRIPERS

[76] Inventor: Brian D. Glassel, 77 Humphries Road, Frankston South, Victoria, Australia

[21] Appl. No.: 104,678

[22] Filed: Oct. 2, 1987

[51] Int. Cl.[4] ..... E01C 23/16

[52] U.S. Cl. ..... 404/93; 404/94; 118/305

[58] Field of Search ..... 404/93, 94, 101, 111; 239/146, 150, 172; 118/108, 305, 308

[56] References Cited

U.S. PATENT DOCUMENTS

| | | | |
|---|---|---|---|
| 2,221,908 | 11/1940 | Bossi | 239/150 X |
| 2,301,848 | 11/1942 | Beaman | 239/150 X |
| 2,357,930 | 9/1944 | Clark | 404/94 |
| 2,633,382 | 3/1953 | Dudley et al. | 404/94 X |
| 2,940,105 | 6/1960 | Woellwarth | 404/94 |
| 3,046,854 | 7/1962 | Wilson | 404/94 |
| 3,052,077 | 9/1962 | Gustafson et al. | 239/150 X |
| 3,148,833 | 9/1964 | Wilson et al. | 239/150 |
| 4,267,973 | 5/1981 | Stewart | 239/150 X |

FOREIGN PATENT DOCUMENTS

| | | | |
|---|---|---|---|
| 3114511 | 10/1982 | Fed. Rep. of Germany | 404/93 |

*Primary Examiner*—Stephen J. Novosad

*Assistant Examiner*—Gay Ann Spahn

*Attorney, Agent, or Firm*—Scully, Scott, Murphy & Presser

[57] ABSTRACT

A ride-On road striper having a rear supporting frame carried by a pair of rear wheels, a front supporting frame carried by at least one front wheel, a propulsion device for driving at least one of the wheels, a pivotal joint for articulating the front frame relative to the rear frame, steering apparatus for pivoting the front frame with respect to the rear frame to cause steering of the striper, an operator's seat and steering controls carried by the front frame. At least one pair of striping devices mounted at the forward end of the front frame are provided, and the striper further includes a striping material storage device and an associated pump carried by the rear frame, delivery lines connecting the storage device to the striping device, controls accessible to the operator for actuating the striping device, the construction of the front frame and the positioning of the striping device on the front frame being such that the operator has a direct line of sight from a seated position on the operator's seat to the striping device whereby the striper may be accurately controlled to perform the striping operation.

7 Claims, 4 Drawing Sheets

57
67
69
58
59
56
63
61
60
11
10
12
31
29
30
28
6
7

35
8
11
4
63
34
1
7
2
3
62
35
1
8
34
11
7
2
3
62
4
63
62
2
3
11
7
1
34
63
4
8
35

RIDE-ON ROAD STRIPERS

FIELD OF THE INVENTION

This invention relates to ride-on road stripers or line markers.

BACKGROUND OF THE INVENTION

Road stripers are presently available in only two broad categories:

(i) relatively small pedestrian machines, and (ii) large ride-on machines capable of road striping at relatively high speeds.

Pedestrian machines are generally used for small striping jobs, such as repair striping over short distances or at intersections, and the striping of relatively compact areas such as municipal car parks and the like. The use of large striping machines is confined, because of their size, high-capital cost and speed of operation, to highway and long street striping jobs. In each category of striper, it is usual for more than one operator to be involved in the use of the machine. Pedestrian machines often require man handling in different areas since their maneuverability is not particularly efficient, even though such machines are designed to be controlled by a pedestrian operator. Larger striping machines may require three or more operators and are of course not suited, economically or practically, to the striping of compact areas or to repair striping.

SUMMARY OF THE INVENTION

It is the object of the present invention to provide a relatively small ride-on road striper which is far more maneuverable than the existing pedestrian machines or the larger machines referred to above and which may be efficiently operated by a single operator.

The invention therefore provides a ride-on road striper comprising a rear supporting frame carried by a pair of rear wheels, a front supporting frame carried by at least one front wheel, propulsion means for driving at least one of said wheels, pivotal joint means for articulating said front frame to said rear frame, steering means for pivoting said front frame with respect to said rear frame to cause steering of said striper, an operator's seat and steering control means carried by said front frame, at least one pair of striping means mounted at the forward end of said front frame, striping material storage means and associated pump means carried by said rear frame, delivery lines connecting said storage means to said striping means, control means accessible to said operator for actuating said striping means, the construction of said front frame and the positioning of said striping means thereon being such that the operator has a direct line of sight from a seated position on said operator's seat to said striping means whereby said striper may be accurately controlled to perform the striping operation.

In one preferred form of the invention, the propulsion means also drives hydraulic pump means for in turn driving said pump means, said storage means and associated pump means being carried by a frame secured to said rear supporting frame and being constructed, at least in part, from hollow members, said hollow members being constructed to operate as a hydraulic fluid storage reservoir for the pump means.

The striping means is preferably mounted on a frame pivoted to said front frame and provided with linkage means connected to said mounting frame and to an operating lever to facilitate adjustment of the height of the frame above the surface to be striped.

In a particularly preferred arrangement, said mounting frame is associated with a further frame carrying a jockey wheel adapted to maintain said further frame at a predetermined height above the surface to be striped, and means for adjustably fixing said mounting frame and said further frame together after height adjustment of said first frame whereby said jockey wheel serves to maintain said striping means at their adjusted height above the surface to be striped.

The operator's seat is preferably supported substantially directly above said articulating pivotal joint means so that articulation occurs generally about the position of the operator to increase the control which the operator exercises over the striper.

The steering means preferably includes a positive drive steering mechanism which causes rotation of a turntable fixed to said rear frame for pivoting the front frame with respect to the rear frame to steer the striper.

The striper also preferably includes means for applying reflective glass beads to the striped surface immediately after application of the painted stripe, said front frame further supporting storage means for the reflective glass beads which preferably form part of the cover for the front wheel(s) of the striper.

BRIEF DESCRIPTION OF THE DRAWINGS

A preferred embodiment of the invention will now be described with reference to the accompanying drawings in which.

Figure 1:
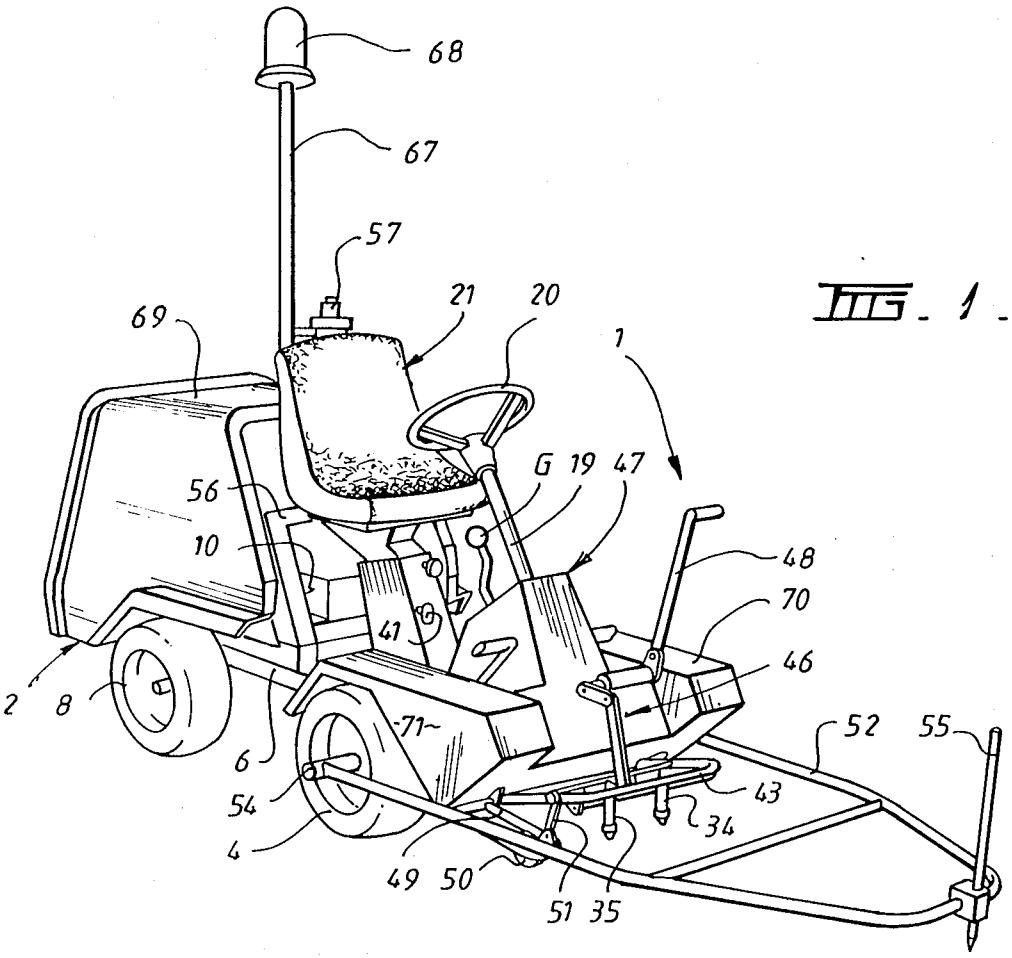
FIG. 1 is a perspective view of a road striper embodying the invention.
Figure 2:
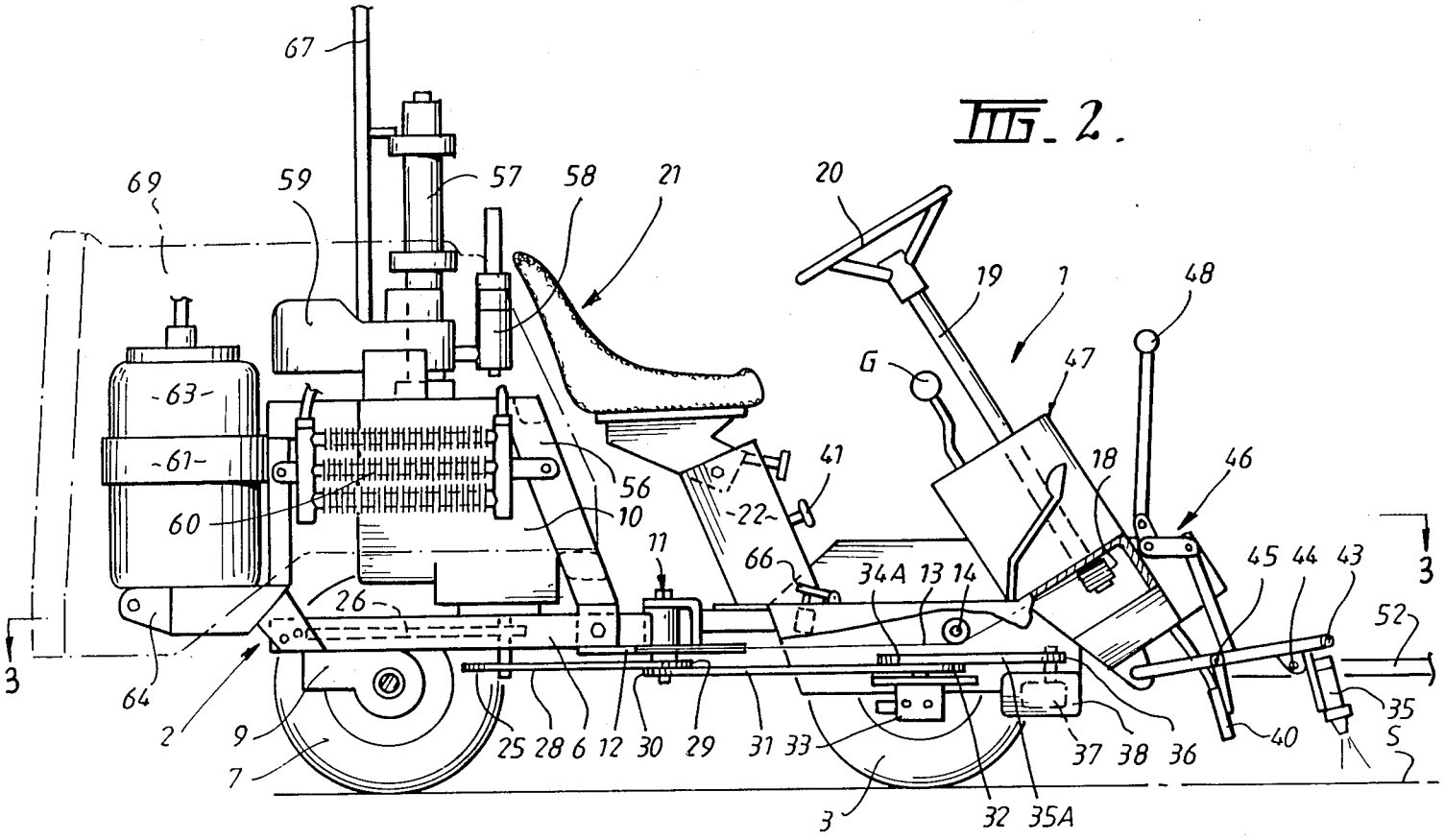
FIG. 2 is a sectional side elevation of the road striper of FIG. 1.

Referring to the drawings, the road striper embodying the invention will be seen to comprise a front portion 1 carried by a front frame or chassis 2 supported by a pair of front wheels 3 and 4, and a rear portion 5 carried by a rear frame or chassis 6 carried by a pair of wheels 7 and 8 driven by a rear transmission 9 which is in turn driven by a motor 10 of any suitable type. The front and rear frames 2 and 6 are connected by an articulating pivot 11 and the rear frame 6 carries a large fixed pulley or turntable 12 connected by a belt drive 13 engaging idler pulleys 14, 15, 16 and 17 and positively engaging a steering pulley 18 which is rotated by a steering shaft 19 having a steering wheel 20 attached thereto. In this way, the front frame 2 may be pivoted with respect to the rear frame 6 about the pivot 11 by rotating the steering wheel 20. This type of steering mechanism is extremely positive and direct and ensures that the operator is in complete control of the direction of travel of the striper at all times.

An operator's seat 21 is adjustably mounted on a pedestal 22 which is rigidly secured to the frame 2 and extends upwardly and slightly rearwardly therefrom such that the operator's seat is located in directly overlying relationship with the articulating pivot 11. This positioning of the operator's seat 21 further improves the control which the operator exercises over the striper since all articulating movements of the vehicle take place about an axis which passes through the vertical axis of the body of the operator.

The motor 10 includes an output shaft 23 to which a first pulley 24 a second pulley 25 are rigidly secured. The pulley 24 is engaged by a belt drive 26 which drivingly engages a pulley 27 rigidly fixed to the input shaft of the transmission 9. The transmission 9 is controlled in a manner known in the art via a gear selector 28 and a clutch lever (not shown).

The pulley 25 is engaged by a drive belt 28 which in turn engages an idler pulley 29 mounted for rotation directly below the articulating pivot 11 and having a further pulley 30 rigidly secured for rotation therewith, which pulley 30 is engaged by a drive belt 31 which in turn engages a pulley 32 fixed to the input shaft of a pump 33 which is adapted to pump paint to a pair of striping jets 34 and 35 mounted at the front of the apparatus, as will be described in greater detail below. A still further pulley 34*a* is driven in unison with the pulley 32 and is engaged by a belt drive 35*a* which in turn engages a pulley 36 attached to the input shaft of a compressor 37 which supplies compressed air to an air tank 38 adapted to supply reflective glass beads to the striped surface via nozzles 39 and 40.

Drive to the pump 33 and compressor 37 may be interrupted by means of lever 41 mounted on the column 22 and connected by means of a mechanism (not shown) to a tensioning idler pulley 42 mounted on the frame 6 and adapted to tension the belt 28 to cause drive to be transmitted to the pump 33 and compressor 37.

Figure 3:
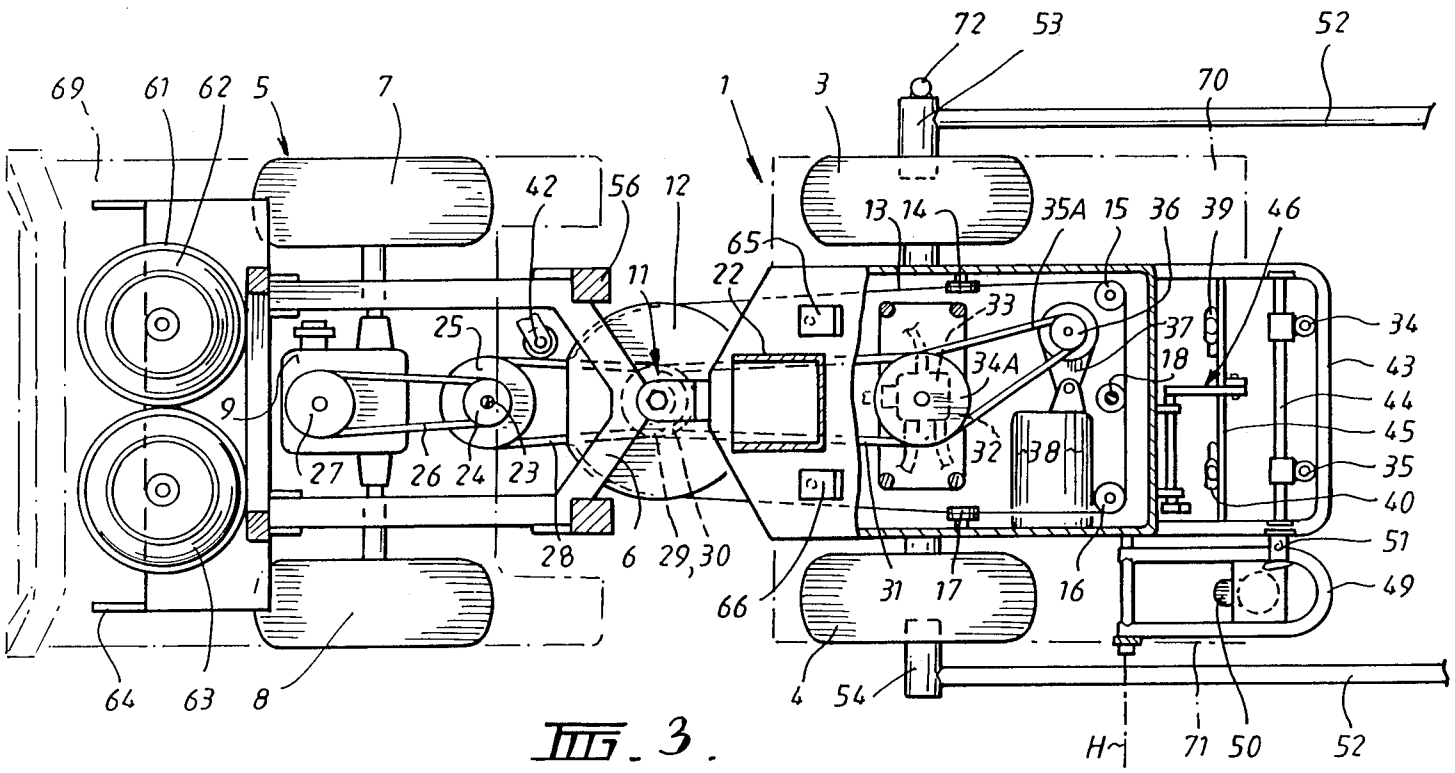
FIG. 3 is a sectional plan view of the road striper of FIGS. 1 and 2.
Figure 4:
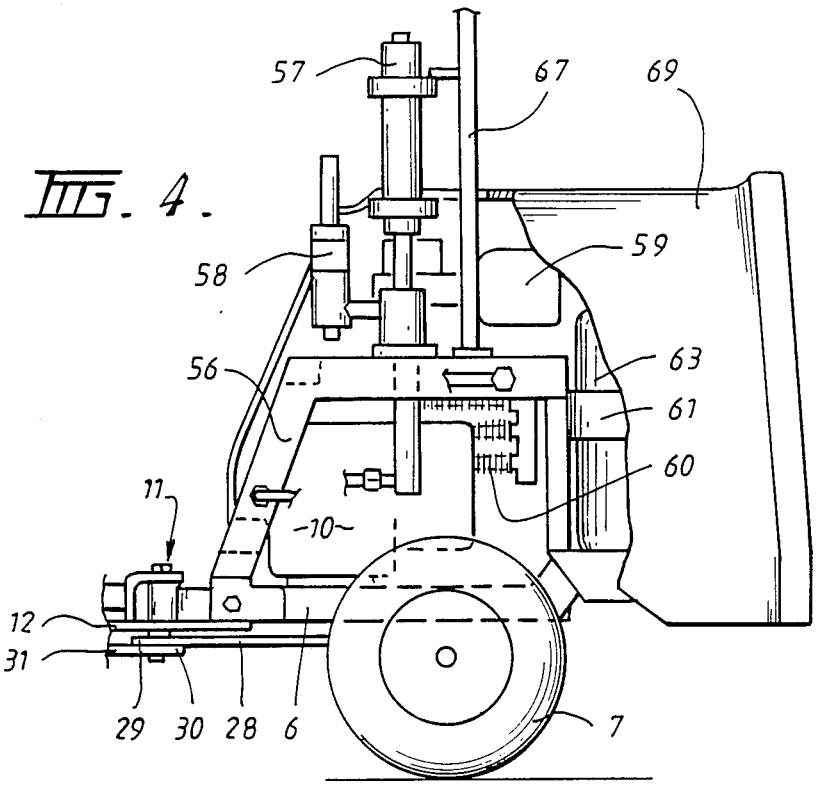
FIG. 4 is a fragmentary sectional side elevation of the rear most portion of the striper.

The striping jets 34 and 35 and the glass bead nozzles 39 and 40 are mounted on a generally rectangular frame 43 which is mounted for pivotal movement with respect to the frame 2 about a generally transverse horizontal axis H. The frame 43 includes mounting bars 44 and 45 for the striping jets 34 and 35 and the glass bead nozzles 39 and 40, as seen most clearly in FIG. 3 of the drawings.

A height adjusting linkage 46 is pivotally mounted on a cover 47 for the front frame 2 and is operable by a lever 48, accessible to the operator, to facilitate vertical adjustment of the frame 43 to vary the height above the surface S to be striped of the jets 34 and 35 and nozzles 39 and 40, to in turn vary the width of the stripes applied to the surface S.

A further frame 49 is also pivotally mounted about the same axis H and carries a jockey wheel 50 which engages the surface S to maintain the frame 49 at a constant predetermined height above the surface S. The frame 49 is adjustably attached to the frame 43 by means of a sliding rod and clamping screw mechanism 51 so that the frame 43 is also kept at its adjusted height above the surface S, irrespective of changes in the level of the surface S from time to time.

A further elongate forwardly extending frame 52 is pivotally mounted on extensions 53, 54 to the axles of the front wheels 3 and 4 and carries a centrally mounted aligning pointer 55 at its forward most end. In the event that the aligning pointer 55 is not required, the frame 52 may be pivoted rearwardly over the operator to be conveniently kept out of the way, or even removed completely. It will be appreciated from the above description that an operator seated in seat 21 has a clear line of vision, without adjusting his position in the seat 21, of the striping jets 34 and 35 and in this way the operator is able to accurately control the position of the jets 34 and 35 without assistance, and without adjusting his seating position.

The rear frame 6 also carries a hollow tubular supporting frame 56 which supports a known hydraulic airless piston pump 57, a filter 58, a fuel tank 59 for the motor 10, an hydraulic fluid cooler 60 and supporting straps 61 for supporting a pair of paint tanks 62, 63 which are additionally supported by a platform 64 secured to the rear end of the frame 6. Hydraulic fluid for the pump 57 is stored in the hollow frame 56 and this results in containing the overall size of the road striper as shown. The pump 57 is supplied with hydraulic fluid under pressure from the pump 33 via hydraulic lines (which are not shown in detail) and paint from the containers 62 and 63 is delivered via lines (not shown in detail) to the striping jets 34 and 35. The operation of the pump 57 and the striping jets 34 and 35 is controlled by foot operated pedals 65 and 66 (FIG. 3), the pedal 65 operating to control the striping jets 34 and 35 manually, and the pedal 66 operating to activate a computer driven actuating system (not shown) if provided. Since the operation of the striping jets 34 and 35 and of the glass bead nozzles 39 and 40 is not central to the present invention, no further description thereof is required. Under normal circumstances of operation, the glass bead jets 39 and 40 operate automatically with the striping jets 34 and 35 unless manually deactivated by conventional means (not shown).

The frame 56 also carries a vertical pole 67 on which a warning light 68 is mounted. The frame 56 and its supported components are partly covered by a moulded cowling 69 and the front wheels 3 and 4 having overlying covers 70 and 71 which are extended at their forward ends to define storage housings for the glass beads to be supplied to the nozzles 39 and 40. A further striping nozzle 72 may be mounted on one or both of the members 53 or 54 to enable edge striping of the surface S.

Figure 5:
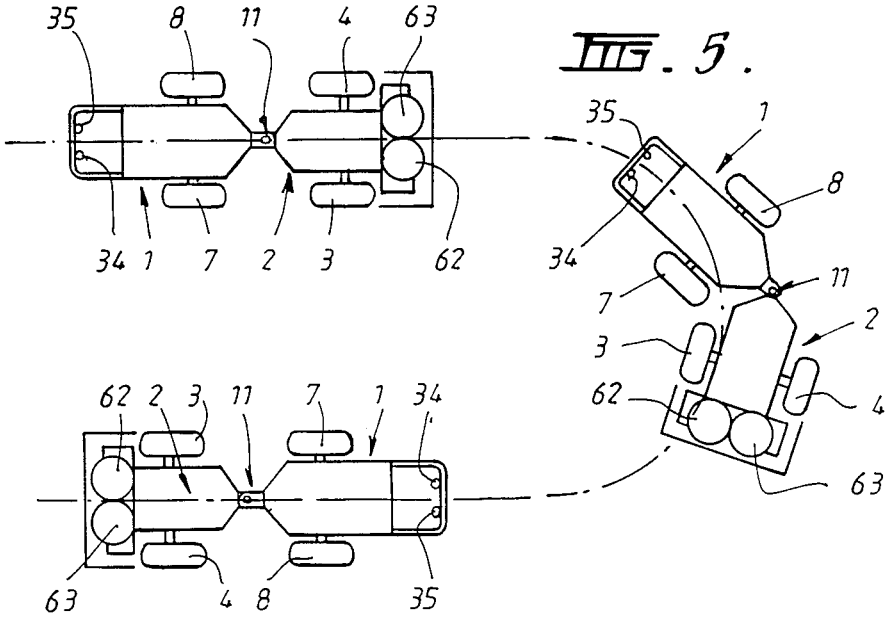
FIG. 5 is a schematic diagram showing the road striper in operation.

It will be appreciated from FIG. 5 of the drawings that the road striper embodying the invention is extremely be capable of striping to a position within 15 inches of a curb or wall, the striper being capable of turning through a tight arc, without running over the painted lines, to stripe a further line parallel to the first line. The striper is also capable, because of the accurate positive steering mechanism, of accurately striping circles, and can even stripe the letter S, which establishes the maneuverability and versatility of the striper. As mentioned above, the operator has a clear view of the striping jets 34 and 35 at all times and therefore may accurately control the vehicle to stripe the surface S in the required positions.

In addition to having substantially improved maneuverability, the road striper is extremely compact, being approximately 86 inches long by 34 inches wide. These dimensions are not critical but it is preferred that the striper should not be more than 10 feet long since otherwise its maneuverability will be compromised. The compactness of the preferred embodiment described above is due primarily to the innovative location of the various components, such as paint containers, the hydraulic pumps, and the location of the hydraulic fluid reservoir in the frame which supports many of these components. The positive steering mechanism and the location of the operator above the articulated pivot also assists in maximizing the maneuverability and compactness of the road striper.

What I claim is:

1. A ride-on road striper comprising a rear supporting frame carried by a pair of rear wheels, a front supporting frame carried by at least one front wheel, propulsion means for driving at least one of said wheels, pivotal joint means for articulating said front frame to said rear frame, steering means for pivoting said front frame with respect to rear frame to cause steering of said striper, an operator's seat and steering control means carried by said front frame, at least one pair of striping means mounted at the forward end of said front frame, striping material storage means and associated striping material pump means carried by said rear frame, delivery lines connecting said storage means to said striping means, control means excessible to said operator for actuating said striping means, wherein the construction of said front frame and the positioning of said striping means thereon being such that the operator has a direct line of sight from a seated position on said operator's seat to said striping means to view the discharge of said striping material on a road surface whereby said striper and said striping means may be accurately controlled to perform the striping operation.

2. A ride-on road striper comprising a rear supporting frame carried by a pair of rear wheels, a front supporting frame carried by at least one front wheel, propulsion means for driving at least one of said wheels, said propulsion means also driving hydraulic pump means for in turn driving said striping material pump means, pivotal joint means for articulating said front frame to said rear frame, steering means for pivoting said front frame with respect to said rear frame to cause steering of said striper, an operator's seat and steering control means carried by said front frame, at least one pair of striping means mounted at the forward end of said front frame, striping material storage means and associated striping material pump means carried by said rear frame, said striping material means and associated striping material pump means being carried by a frame secured to said rear supporting frame and being constructed, at least in part, from hollow members, said hollow members being constructed to operate as an hydraulic fluid storage reservoir for the hydraulic pump means, delivery lines connecting said storage means to said striping means, control means accessible to said operator for actuating said striping means, the construction of said front frame and the positioning of said striping means thereon being such that the operator has a direct line of sight from a seated position on said operator's seat to said striping means whereby said striper may be accurately controlled to perform the striping operation.

3. The striper of Claim 1 or 2, wherein said striping means is mounted on a mounting frame pivoted to said front frame and provided with linkage means connected to said mounting frame and to an operating lever to facilitate adjustment of the height of the mounting frame above the road surface to be striped, said striping means being positioned on said frame in direct view of said operator such that said operator may visually adjust the height of said frame to control said striping means during said striping operation.

4. A ride-on road striper comprising a rear supporting frame carried by a pair of rear wheels, a front supporting frame carried by at least one front wheel, propulsion means for driving at least one of said wheels, pivotal joint means for articulating said front frame to said rear frame, steering means for pivoting said front frame with respect to said rear frame to cause steering of said striper, an operator's seat and steering control means carried by said front frame, at least one pair of striping means mounted at the forward end of said front frame, said striping means being mounted on a mounting frame pivoted to said front frame and provided with linkage means connected to said mounting frame and to an operating lever to facilitate adjustment of the height of the frame above the surfact to be striped, said mounting frame including a second frame carrying a jockey wheel adapted to maintain said second frame at a predetermined height above the surface to be striped, and means for adjustably fixing said mounting frame and said second frame together after height adjustment of said second frame whereby said jockey wheel serves to maintain said striping means at their adjusted height above the surface to be striped, striping material storage means and associated striping material pump means carried by said rear frame, delivery lines connecting said storage means to said striping means, control means accessible to said operator for actuating said striping means, the construction of said front frame and the positioning of said striping means thereon being such that the operator has a direct line of sight from a seated position on said operator's seat to said striping means whereby said striper may be accurately controlled to perform the striping operation.

5. A ride-on road striper comprising a rear supporting frame carried by a pair of rear wheels, a front supporting frame carried by at least one front wheel, propulsion means for driving at least one of said wheels, pivotal joint means for articulating said front frame to said rear frame, said pivotal joint means being positioned substantially centrally of said striper at a connection point between said front and rear frames, steering means for pivoting said front frame with respect to said rear frame to cause steering of said striper, an operator's seat and steering control means carried by said front frame, said operator's seat being supported substantially directly above said articulating pivotal joint means so that articulation occurs generally about the position of the operator to increase the control which the operator exercises over the striper, at least one pair of striping means mounted at the forward end of said front frame, striping material storage means and associated striping material pump means carried by said rear frame, delivery lines connecting said storage means to said striping means, control means excessible to said operator for actuating said striping means, wherein the construction of said front frame and the positioning of said striping means thereon being such that the operator has a direct line of sight from a seated position on said operator seat to said striping means to view the discharge of said striping material on a road surface whereby said striper and said striping means may be accurately controlled to perform the striping operation.

6. The striper of Claim 1, 2, 4 or 5, wherein said steering means includes a direct belt drive engaging a turntable fixed to said rear frame for pivoting the front frame, said front wheel and said striping means with respect to the rear frame to steer the striper.

7. The striper of claim 1, 2, 4 or 5 further including means for applying reflective glass beads to the striped surface, said front frame including storage means for said beads mounted over said front wheel(s) and forming part of a cover for said front frame.

* * * * *